US010086245B2

(12) United States Patent
Nakano

(10) Patent No.: US 10,086,245 B2
(45) Date of Patent: Oct. 2, 2018

(54) GOLF CLUB

(71) Applicant: SUMITOMO RUBBER INDUSTRIES, LTD., Kobe-shi, Hyogo (JP)

(72) Inventor: Takashi Nakano, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

(21) Appl. No.: 15/583,382

(22) Filed: May 1, 2017

(65) Prior Publication Data

US 2018/0001166 A1 Jan. 4, 2018

(30) Foreign Application Priority Data

Jun. 30, 2016 (JP) ..... 2016-129557

(51) Int. Cl.
*A63B 53/10* (2015.01)
*A63B 53/04* (2015.01)

(52) U.S. Cl.
CPC ..... *A63B 53/10* (2013.01); *A63B 53/0466* (2013.01)

(58) Field of Classification Search
CPC ..... A63B 53/10
See application file for complete search history.

(56) References Cited

U.S. PATENT DOCUMENTS 5,156,396 A * 10/1992 Akatsuka ..... A63B 53/10 273/DIG. 23
2004/0038744 A1* 2/2004 Kumamoto ..... A63B 53/10 473/319
2008/0070716 A1* 3/2008 Kumamoto ..... A63B 53/10 473/289
2012/0295734 A1* 11/2012 Hasegawa ..... A63B 53/10 473/319
2013/0095949 A1* 4/2013 Hasegawa ..... A63B 53/10 473/318
2015/0157906 A1* 6/2015 Shimono ..... A63B 53/10 473/319
2015/0297963 A1* 10/2015 Shimono ..... A63B 53/10 473/319

FOREIGN PATENT DOCUMENTS

JP 2012-239574 A 12/2012
JP 5824594 B1 11/2015

* cited by examiner

*Primary Examiner* — John E Simms, Jr.
(74) *Attorney, Agent, or Firm* — Birch, Stewart, Kolasch & Birch, LLP

(57) ABSTRACT

A golf club 2 includes a shaft 6 having a tip end Tp and a butt end Bt, a head 4 and a grip 8. The shaft 6 includes a plurality of carbon fiber reinforced layers. The layers include a straight layer, a bias layer and a hoop layer. When a weight of the hoop layer is defined as WF, and a shaft weight is defined as WS, WF/WS is 0.18 or greater. The shaft weight WS is 42 g or less. In the shaft 6, a point 200 mm distant from the butt end Bt is defined as P1, and a region between the point P1 and the butt end Bt is defined as a specific butt region Rb. A weight of the hoop layer in the specific butt region Rb is defined as WFb, and a shaft weight in the specific butt region Rb is defined as WSb.

8 Claims, 9 Drawing Sheets

GOLF CLUB

The present application claims priority on Patent Application No. 2016-129557 filed in JAPAN on Jun. 30, 2016, the entire contents of which are hereby incorporated by reference.

BACKGROUND OF THE INVENTION

Field of the Invention

The present invention relates to a golf club.

Description of the Related Art

A golf club shaft in which a position of a center of gravity of the shaft is considered has been proposed. Japanese Patent Application Laid-Open No. 2012-239574 (US2012/0295734A1) discloses a shaft having a ratio of a center of gravity of the shaft that is equal to or greater than 0.52 but equal to or less than 0.65. A golf club shaft in which a flexural rigidity distribution is considered has also been proposed. Japanese Patent No. 5824594 discloses a shaft having a specific shape of a graph for an EI distribution.

SUMMARY OF THE INVENTION

The conventional techniques are effective in improvement of head speed. Meanwhile, the demand by golf players has been more and more increased.

Weight reduction of a shaft is an effective means for improvement of head speed. However, the weight reduction decreases the using amount of material to deteriorate a degree of freedom of the design of the shaft. It is not easy to produce an optimal design for enhancing the head speed while securing strength.

It is an object of the present invention to provide a golf club that includes a shaft having a characteristic capable of enhancing head speed and that is excellent in flight distance performance.

A preferable golf club includes a shaft having a tip end and a butt end, a head, and a grip. The shaft includes a plurality of carbon fiber reinforced layers. The carbon fiber reinforced layers include a straight layer, a bias layer, and a hoop layer. If a weight of the hoop layer is defined as WF, and a shaft weight is defined as WS, WF/WS is equal to or greater than 0.18. The shaft weight WS is equal to or less than 42 g.

In the shaft, a point 200 mm distant from the butt end is defined as P1, a region between the point P1 and the butt end is defined as a specific butt region, a weight of the hoop layer in the specific butt region is defined as WFb, and a shaft weight in the specific butt region is defined as WSb. Preferably, WFb/WSb is equal to or greater than 0.30.

Preferably, the specific butt region includes the hoop layer, the number of plies of which is three or greater.

Preferably, the shaft having an inner diameter at the point P1 of equal to or greater than 14.0 mm.

A weight of the straight layer is defined as WT. Preferably, WF/WT is equal to or greater than 0.25.

In the shaft, an EI value at a point 830 mm distant from the tip end is defined as E8, an EI value at a point 930 mm distant from the tip end is defined as E9, and an EI value at a point 1030 mm distant from the tip end is defined as E10. In the present application, a graph obtained by plotting these three EI values E8, E9 and E10 on an x-y coordinate plane in which the x axis represents a distance (mm) between the tip end and a measurement point and the y axis represents the EI value ($kgf \cdot m^2$) is considered. In the graph, a gradient of a linear expression obtained by approximating the three points with a least-square method is defined as M3. Preferably, the gradient M3is equal to or less than 0.0100.

In the shaft, an EI value at a point 1030 mm distant from the tip end is defined as E10. Preferably, E10 is equal to or less than 5.0 ($kgf \cdot m^2$).

A distance between the tip end of the shaft and a center of gravity of the shaft is defined as Lg, and a length of the shaft is defined as Ls. Preferably, Lg/Ls is equal to or greater than 0.50.

DESCRIPTION OF THE PREFERRED EMBODIMENTS

The present invention will be described later in detail based on preferred embodiments with appropriate reference to the drawings.

The term "layer" and the term "sheet" are used in the present application. The "layer" is a term for after being wound. Meanwhile, the "sheet" is a term for before being wound. The "layer" is formed by winding the "sheet". That is, the wound "sheet" forms the "layer".

In the present application, an axial direction means an axial direction of a shaft. In the present application, a circumferential direction means a circumferential direction of the shaft.

Figure 1:
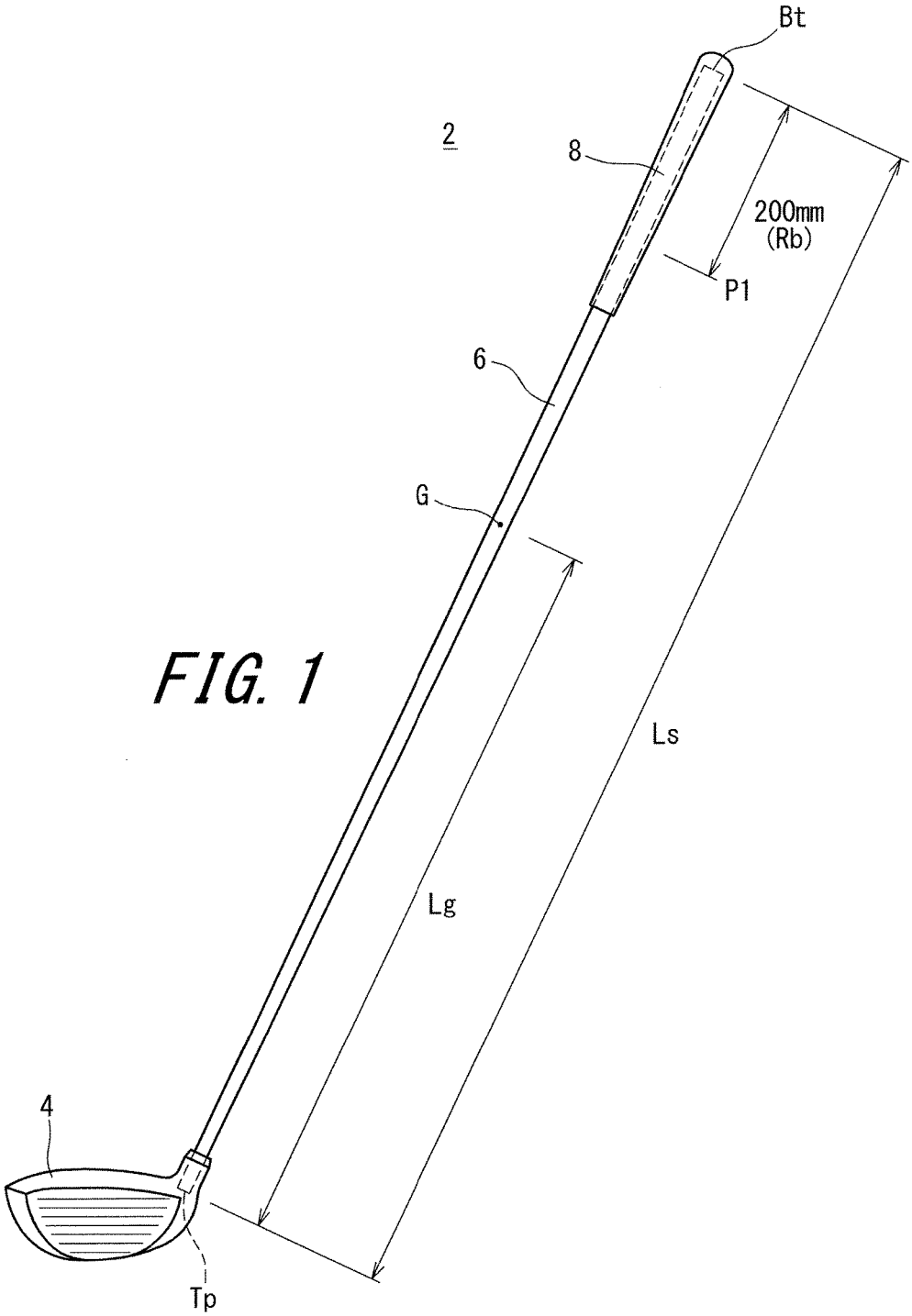
FIG. 1 shows a golf club including a shaft according to a first embodiment.

FIG. 1 shows a golf club 2 according to an embodiment of the present invention. The golf club 2 includes a head 4, a shaft 6, and a grip 8. The head 4 is provided at a tip portion of the shaft 6. The grip 8 is provided at a butt portion of the shaft 6. The shaft 6 is a shaft for wood type.

The head 4 and the grip 8 are not limited. Examples of the head 4 include a wood-type golf club head, an iron-type golf club head, a putter head, and the like. The head 4 according to the present embodiment is a wood-type golf club head.

The shaft 6 is formed by a plurality of fiber reinforced resin layers. The shaft 6 is a tubular body. Although not shown in the drawings, the shaft 6 has a hollow structure. As shown in FIG. 1, the shaft 6 has a tip end Tp and a butt end Bt. In the golf club 2, the tip end Tp is positioned in the head 4. In the golf club 2, the butt end Bt is positioned in the grip 8.

In FIG. 1, a double-pointed arrow Lg shows a distance between the tip end Tp and a center of gravity G of the shaft. The distance Lg is measured along the axial direction. In FIG. 1, a double-pointed arrow Ls shows a length of the shaft 6.

In the present application, Lg/Ls is also referred to as a ratio of a center of gravity of a shaft. By increasing the ratio of the center of gravity of a shaft, easiness of swing is secured even if the head weight is increased. Therefore, head speed is improved and flight distance can be increased. In this respect, Lg/Ls is preferably equal to or greater than 0.50, more preferably equal to or greater than 0.51, and still more preferably equal to or greater than 0.52. In view of the strength of a tip portion, Lg/Ls is preferably equal to or less than 0.61, and more preferably equal to or less than 0.60.

The shaft 6 is formed by winding a plurality of prepreg sheets. In these prepreg sheets, fibers are oriented substantially in one direction. The prepreg in which fibers are oriented substantially in one direction is also referred to as a UD prepreg. The term "UD" stands for uni-direction. Prepregs which are not the UD prepreg may be used. For example, fibers contained in the prepreg sheet may be woven.

The prepreg sheet has a fiber and a resin. The resin is also referred to as a matrix resin. Examples of the fiber include a carbon fiber and a glass fiber. Typically, the matrix resin is a thermosetting resin.

Examples of the matrix resin of the prepreg sheet include a thermosetting resin and a thermoplastic resin. In respect of strength of the shaft, the matrix resin is preferably an epoxy resin.

The shaft 6 is manufactured by a so-called sheet-winding method. In the prepreg, the matrix resin is in a semi-cured state. In the shaft 6, the prepreg sheet is wound and cured. The curing means the curing of the semi-cured matrix resin. The curing is attained by heating. The manufacturing process of the shaft 6 includes a heating process. The heating cures the matrix resin of the prepreg sheet.

Figure 2:
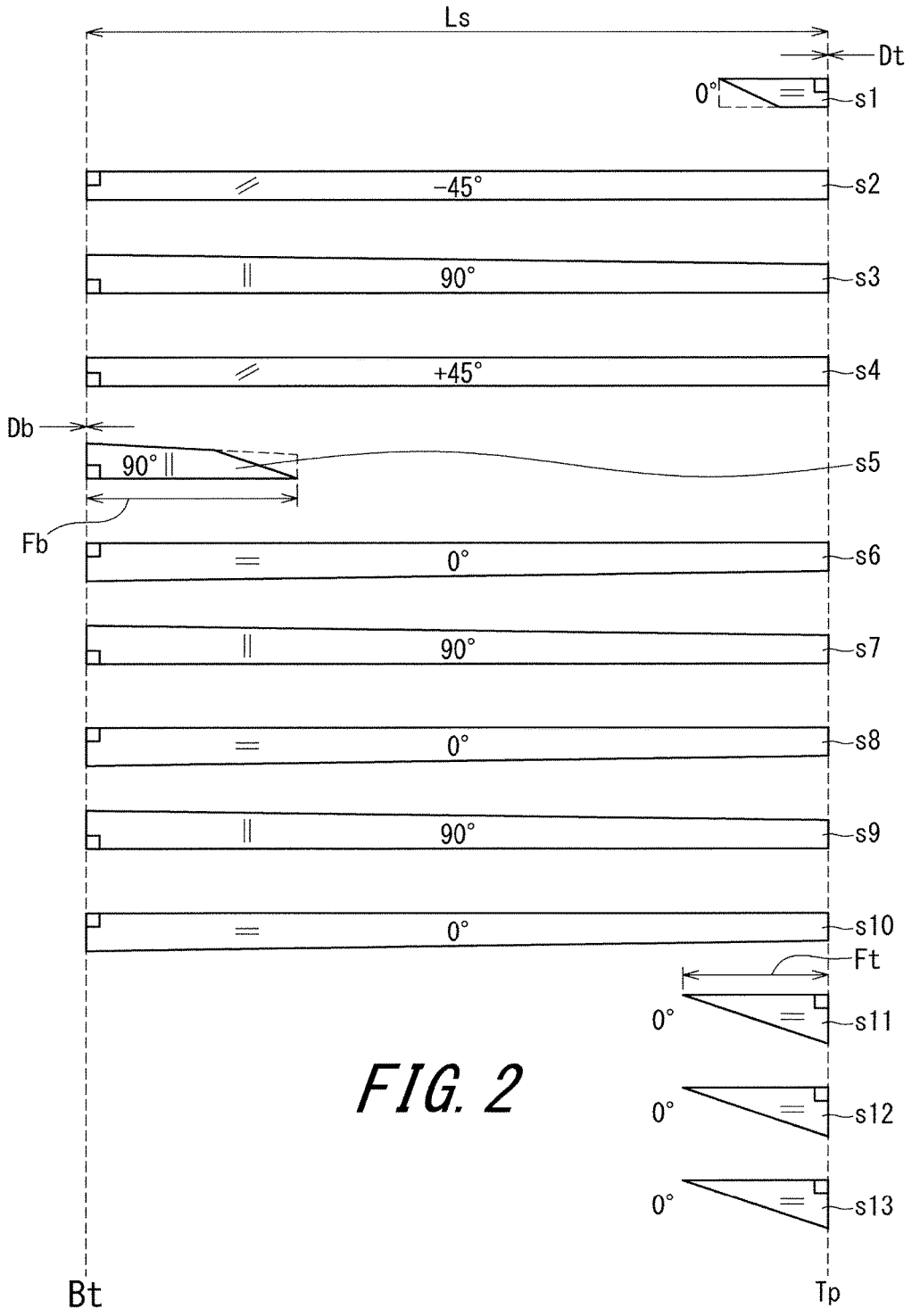
FIG. 2 is a developed view of the shaft according to the first embodiment (and Example 1)

FIG. 2 is a developed view of the prepreg sheets constituting the shaft 6. FIG. 2 shows the sheets constituting the shaft 6. The shaft 6 is constituted with a plurality of sheets. In the embodiment of FIG. 2, the shaft 6 is constituted with thirteen sheets. The shaft 6 includes a first sheet s1 to a 13th sheet s13. The developed view shows the sheets constituting the shaft in order from the radial inside of the shaft. The sheets are wound in order from the sheet located on the uppermost side in FIG. 2. In FIG. 2, the horizontal direction of the figure coincides with the axial direction. In FIG. 2, the right side of the figure is the tip side of the shaft. In FIG. 2, the left side of the figure is the butt side of the shaft.

FIG. 2 shows not only the winding order of the sheets but also the disposal of each of the sheets in the axial direction of the shaft. For example, in FIG. 2, an end of the sheet s1 is located at the tip end Tp.

The shaft 6 includes a straight layer and a bias layer. In FIG. 2, the orientation angle of the fiber is described. A sheet described as "0°" is a straight sheet. The straight sheet constitutes the straight layer.

The straight layer is a layer in which the orientation of the fiber is substantially 0 degree to the axial direction. Usually, the orientation of the fiber is not to be completely parallel to the axis direction of the shaft due to an error or the like in winding. In the straight layer, an absolute angle θa of the fiber to the axis line of the shaft is equal to or less than 10 degrees. The absolute angle θa is an absolute value of an angle between the axis line of the shaft and the direction of the fiber. That is, the absolute angle θa of equal to or less than 10 degrees means that an angle Af between the direction of the fiber and the axis direction of the shaft is −10 degrees or greater but +10 degrees or less.

In the first embodiment of FIG. 2, the straight sheets are the sheet s1, the sheet s6, the sheet s8, the sheet s10, the sheet s11, the sheet s12 and the sheet s13. The straight layer contributes to improvement of a flexural rigidity and a flexural strength.

The bias layer can enhance a torsional rigidity and a torsional strength of the shaft. Preferably, the bias layer includes a pair of sheets in which the orientations of the fibers are inclined in opposite directions to each other. Preferably, the pair of sheets include a layer having an angle Af of −60 degrees or greater but −30 degrees or less and a layer having an angle Af of 30 degrees or greater but 60 degrees or less. That is, preferably, the absolute angle θa in the bias layer is 30 degrees or greater but 60 degrees or less.

In the shaft 6, sheets constituting the bias layer are the sheet s2 and the sheet s4. In FIG. 2, the angle Af is described in each sheet. The plus (+) and minus (−) in the angle Af show that the fibers of bias sheets stacked to each other are inclined in opposite directions to each other. In the present application, the sheet for the bias layer is also simply referred to as a bias sheet.

A hoop layer is a layer so disposed that the fiber is oriented along the circumferential direction of the shaft. Preferably, the absolute angle θa in the hoop layer is substantially 90 degrees to the axis line of the shaft. However, the orientation of the fiber to the axis direction of the shaft may not be completely set to 90 degrees due to an error or the like in winding. Normally, in the hoop layer, the absolute angle θa is equal to or greater 80 degrees. The upper limit value of the absolute angle θa is 90 degrees. That is, the absolute angle θa of the hoop layer is equal to or less than 90 degrees.

The hoop layer contributes to increases in the crushing rigidity and the crushing strength of the shaft. The crushing rigidity is a rigidity against a crushing deformation. The crushing deformation is generated by a force crushing the shaft toward the inside in the radial direction thereof. In a typical crushing deformation, the cross section of the shaft is deformed from a circular shape to an elliptical shape. The crushing strength is a strength against the crushing deformation. The crushing strength can also be involved with the flexural strength. Crushing deformation can be generated linked with flexural deformation. Particularly in a shaft that is lightweight and has a small wall thickness, this linkage is large. The improvement in the crushing strength can contribute to improvement of the flexural strength.

In the embodiment of FIG. 2, prepreg sheets for the hoop layer are the sheet s3, the sheet s5, the sheet s7 and the sheet s9. The prepreg sheet for the hoop layer is also referred to as a hoop sheet. The shaft 6 includes the hoop layer s3 sandwiched between the bias layers s2 and s4.

A united sheet is used in the embodiment of FIG. 2. The united sheet is formed by stacking a plurality of sheets.

Four united sheets are formed in the embodiment of FIG. 2. A first united sheet is a combination of the sheet s2, the sheet s3, and the sheet s4. A second united sheet is a combination of the sheet s5 and the sheet s6. A third united sheet is a combination of the sheet s7 and the sheet s8. A fourth united sheet is a combination of the sheet s9 and the sheet s10.

As described above, in the present application, the sheet and the layer are classified by the orientation angle of the fiber. In addition, in the present application, the sheet and the layer are classified by the length thereof in the axial direction.

A layer disposed wholly in the axial direction is referred to as a full length layer. A sheet disposed wholly in the axial direction is referred to as a full length sheet. The wound full length sheet forms the full length layer.

Meanwhile, a layer disposed partially in the axial direction is referred to as a partial layer. A sheet disposed partially in the axial direction is referred to as a partial sheet. The wound partial sheet forms the partial layer.

The full length layer that is the bias layer is referred to as a full length bias layer. In the present application, the full length layer that is the straight layer is referred to as a full length straight layer. In the present application, the full length layer that is the hoop layer is referred to as a full length hoop layer.

In the present application, the partial layer that is the straight layer is referred to as a partial straight layer.

Hereinafter, the manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine, or may be manually performed. In the manual case, for example, a cutter knife is used.

(2) Stacking Process

A plurality of sheets are stacked in the process to produce the united sheets. In the stacking process, heating or a press may be used.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

A winding body is obtained in the winding process. In the winding body, the prepreg sheet is wound around the outside of the mandrel. The winding is performed by, for example, rolling the object to be wound on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The wrapping tape is wrapped while tension is applied to the tape. A pressure is applied to the winding body by the wrapping tape. The pressure contributes to reduction of voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The fastening force of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is preferably performed after the process of extracting the mandrel.

(7) Process of Cutting Both Ends

Both the end parts of the cured laminate are cut in the process. The cutting flattens the end face of the tip end Tp and the end face of the butt end Bt.

(8) Polishing Process

The surface of the cured laminate is polished in the process. As the trace of the wrapping tape, spiral unevenness is present on the surface of the cured laminate. The polishing extinguishes the unevenness to smooth the surface of the cured laminate.

(9) Coating Process

The cured laminate after the polishing process is subjected to coating.

In the present application, the same reference character is used in the layer and the sheet. For example, a layer formed by the sheet s1 is the layer s1.

In the shaft 6, the full length sheets are the sheet s2, the sheet s3, the sheet s4, the sheet s6, the sheet s7, the sheet s8, the sheet s9 and the sheet s10. The sheet s2 and the sheet s4 are the full length bias sheets. The sheet s6, the sheet s8 and the sheet s10 are the full length straight sheets. The sheet s3, the sheet s7 and the sheet s9 are the full length hoop sheets.

In the shaft 6, the partial sheets are the sheet s1, the sheet s5, the sheet s11, the sheet s12 and the sheet s13. The sheet s1, the sheet s11, the sheet s12 and the sheet s13 are the tip partial sheets. The sheet s5 is the butt partial sheet.

A double-pointed arrow Dt in FIG. 2 represents a distance between the tip partial sheet and the tip end Tp. The distance Dt is measured along the axial direction. In hitting, stress is apt to be concentrated on the vicinity of the end face of the hosel. In this respect, the distance Dt is preferably equal to or less than 20 mm. The distance Dt is more preferably equal to or less than 10 mm. The distance Dt may be 0 mm. In the present embodiment, the distance Dt is 0 mm.

A double-pointed arrow Ft in FIG. 2 represents a length (full length) of the tip partial sheet. The length Ft is measured along the axial direction. In hitting, stress is apt to be concentrated on the vicinity of the end face of the hosel. In this respect, the length Ft is preferably equal to or greater than 50 mm, more preferably equal to or greater than 100 mm, and still more preferably equal to or greater than 150 mm. In respect of the position of the center of gravity of the shaft, the length Ft is preferably equal to or less than 400 mm, more preferably equal to or less than 350 mm, and still more preferably equal to or less than 300 mm.

A double-pointed arrow Db in FIG. 2 represents a distance between the butt partial sheet and the butt end Bt. The distance Db is measured along the axial direction. In respect of the position of the center of gravity of the shaft, the distance Db is preferably equal to or less than 100 mm. The distance Db is more preferably equal to or less than 70 mm, and still more preferably equal to or less than 50 mm. The distance Db may be 0 mm. In the present embodiment, the distance Db is 0 mm.

A double-pointed arrow Fb in FIG. 2 represents a length (full length) of the butt partial sheet. The length Fb is measured along the axial direction. In respect of the position of the center of gravity of the shaft, the weight of the butt partial sheet is preferably great. In this respect, the length Fb is preferably equal to or greater than 250 mm, more preferably equal to or greater than 300 mm, and still more preferably equal to or greater than 350 mm. An excessively large length Fb reduces the effect of shifting the position of the center of gravity of the shaft. In this respect, the length Fb is preferably equal to or less than 650 mm, more preferably equal to or less than 600 mm, still more preferably equal to or less than 580 mm, and yet still more preferably equal to or less than 560 mm.

The embodiment of FIG. 2 includes one butt partial sheet. A plurality of butt partial sheets may be provided.

The butt partial sheet s5 is the hoop sheet. The distance Db of the butt partial sheet s5 is 0 mm. The butt partial sheet s5 is disposed outside the full length bias sheets s2 and s4. At least one full length straight sheet is provided outside the butt partial sheet s5.

The sheet s1 is the straight tip partial sheet. The sheet s1 is disposed inside the full length bias sheets s2 and s4.

The sheet s11 is the straight tip partial sheet. The sheet s11 is disposed outside the outermost full length straight layer s10. The sheet s12 is the straight tip partial sheet. The sheet s12 is disposed outside the sheet s11. The sheet s13 is disposed outside the sheet s12.

In the present embodiment, a glass fiber reinforced prepreg is used. In the embodiment, the glass fiber is oriented substantially in one direction. That is, the glass fiber reinforced prepreg is a UD prepreg. A glass fiber reinforced prepreg other than the UD prepreg may be used. For example, glass fibers contained in the prepreg may be woven.

In the embodiment, the sheet s1 is a glass fiber reinforced sheet. In the embodiment, the glass fiber reinforced sheet s1 is disposed inside the bias layers s2 and s4.

A prepreg other than the glass fiber reinforced prepreg is a carbon fiber reinforced prepreg. Sheets other than the sheet s1 are carbon fiber reinforced sheets. Examples of the carbon fiber include a PAN based carbon fiber and a pitch based carbon fiber.

The glass fiber has a large compressive breaking strain. The glass fiber is effective in improvement of an impact-absorbing energy. The impact strength of the tip portion of the shaft is improved by adopting the glass fiber reinforced layer as the tip partial layer.

Examples of the fiber used for a low-elastic layer include a low-elastic carbon fiber in addition to the glass fiber. A preferable low-elastic carbon fiber is a pitch based carbon fiber.

The ratio of the center of gravity of the shaft can be increased by increasing the weight of the butt portion. However, if the weight of the butt portion is increased, the flexural rigidity of the butt portion is apt to be excessively large. In this case, the butt portion is hard to bend and to thereby reduce a cock-analogous effect (to be described later). By adopting the hoop layer as the butt partial layer, the flexural rigidity of the butt portion can be suppressed while the ratio of the center of gravity of the shaft is increased. In the shaft 6, the head speed is increased by the synergistic effect of the ratio of the center of gravity of the shaft and the cock-analogous effect (to be described later).

[Sandwich Structure]

The laminated constitution in FIG. 2 includes the first hoop layer s3, the second hoop layer s5, the third hoop layer s7 and the fourth hoop layer s9.

The second hoop layer s5 is positioned outside the first hoop layer s3. An interposition layer is present between the first hoop layer s3 and the second hoop layer s5. The interposition layer is a layer (bias layer) other than the hoop layer.

The third hoop layer s7 (full length hoop layer) is positioned outside the second hoop layer s5 (butt partial hoop layer). An interposition layer is present between the second hoop payer s5 (butt partial hoop layer) and the third hoop layer s7 (full length hoop layer). The interposition layer is a layer (straight layer) other than the hoop layer.

The fourth hoop layer s9 (full length hoop layer) is positioned outside the third hoop layer s7 (full length hoop layer). An interposition layer is present between the third hoop layer s7 (full length hoop layer) and the fourth hoop layer s9 (full length hoop layer). The interposition layer is a layer (full length straight layer) other than the hoop layer.

The structure in which an interposition layer is present between two hoop layers is also referred to as a sandwich structure in the present application. The laminated constitution in FIG. 2 includes a plurality of sandwich structures.

In the deformation of a shaft, the flexural deformation causes the crushing deformation. In the crushing deformation, the curvature of the cross-section shape of the shaft varies depending on its circumferential position. That is, when the cross-section is deformed to have an elliptical shape by the crushing deformation, a portion having a small curvature and a portion having a large curvature are combined in the cross-section. The hoop layer is hard to follow the variation of the curvature since the fibers are oriented in the circumferential direction. Meanwhile, the straight layer and the bias layer are apt to follow the variation of the curvature since the fibers are not oriented in the circumferential direction.

Therefore, when the hoop layers are overlapped to each other, the layers are apt to be peeled from each other because of a difference between the radial positions of the hoop layers. On the other hand, when the straight layer or the bias layer is overlapped with the hoop layer, the peeling between layers is comparatively less likely to occur. From these viewpoints, it is preferable that two hoop layers are not overlapped to each other. It is preferable that all the plurality of hoop layers are not overlapped to each other. It is preferable that a layer other than the hoop layer is interposed between the hoop layers. It is preferable that a layer other than the hoop layer is interposed every between the plurality of hoop layers. It is preferable that the straight layer and/or the bias layer are/is interposed between the hoop layers. That is, the sandwich structure is preferred. The sandwich structure enhances the flexural strength. In light of weight reduction, the thickness of the hoop layer per layer is preferably equal to or less than 0.05 mm. In light of enhancing the effect brought by the hoop layer, the thickness of the hoop layer per layer is preferably equal to or greater than 0.02 mm.

The hoop layer s3, the hoop layer s7 and the hoop layer s9 are the full length layers. Therefore, the effect of the sandwich structure is exhibited over the full length of the shaft, and the strength of the whole shaft is enhanced.

Figure 3:
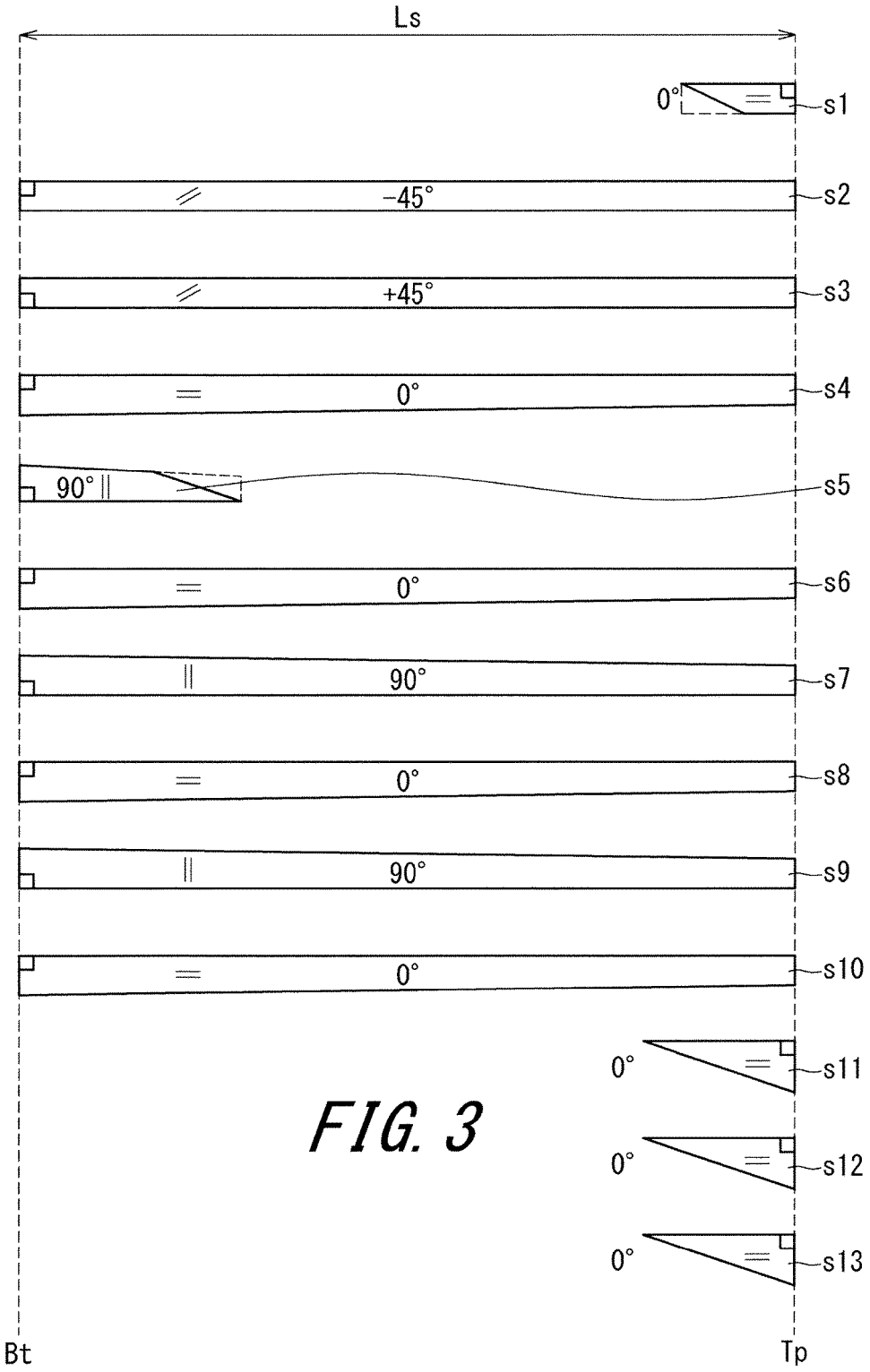
FIG. 3 is a developed view of a shaft according to a second embodiment (and Example 2)

FIG. 3 is a developed view showing a laminated constitution of a second embodiment. The difference between FIG. 3 and FIG. 2 is that the full length hoop layer sandwiched between the bias layers is not present and the full length straight layer s4 is disposed instead of the hoop layer.

Figure 4:
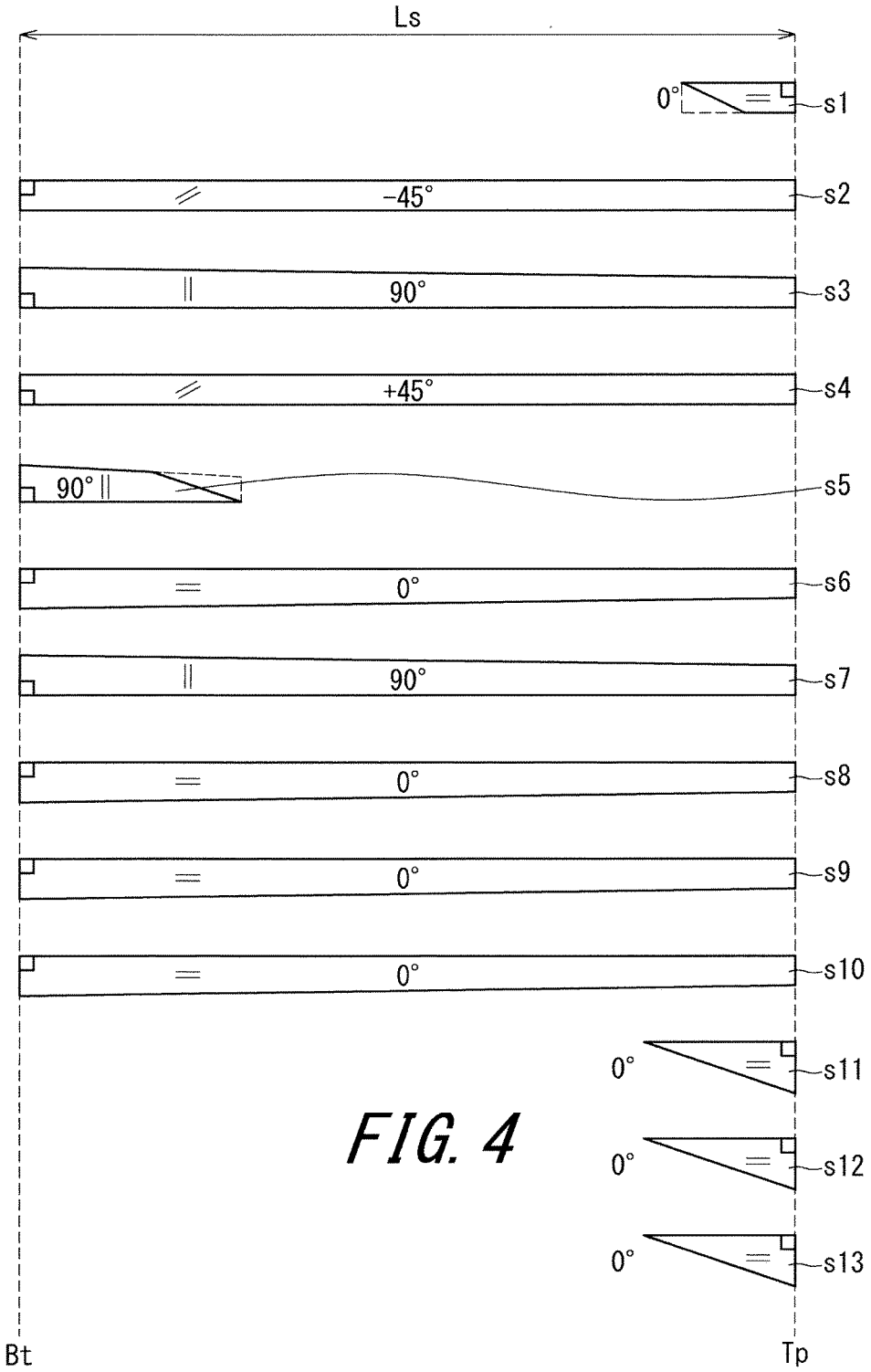
FIG. 4 is a developed view of a shaft according to a third embodiment (and Example 3)

FIG. 4 is a developed view showing a laminated constitution of a third embodiment. As compared with the embodiment of FIG. 2, the hoop layer s9 is not present and the full length straight layer s9 is disposed instead of the hoop layer s9 in the third embodiment.

Figure 5:
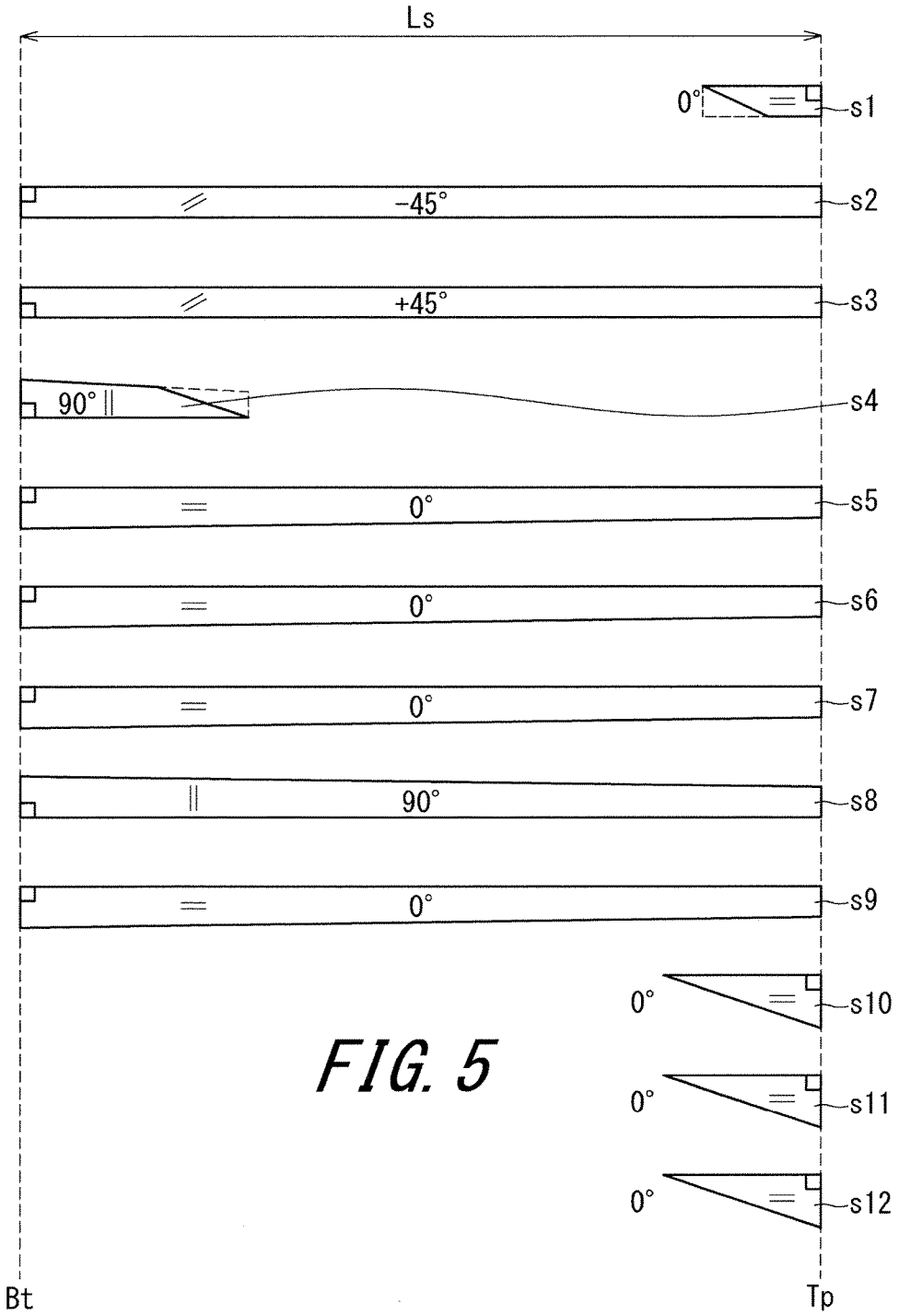
FIG. 5 is a developed view of a shaft according to a reference example 1 (and Comparative Example 1)

FIG. 5 is a developed view showing a laminated constitution of reference example 1. As compared with the embodiment of FIG. 2, the full length hoop layer s3 is not present in the reference example 1. Furthermore, in the reference example 1, the full length straight layer s6 is disposed instead of the full length hoop layer s7. The laminated constitution of the reference example 1 may also be Example.

Figure 6:
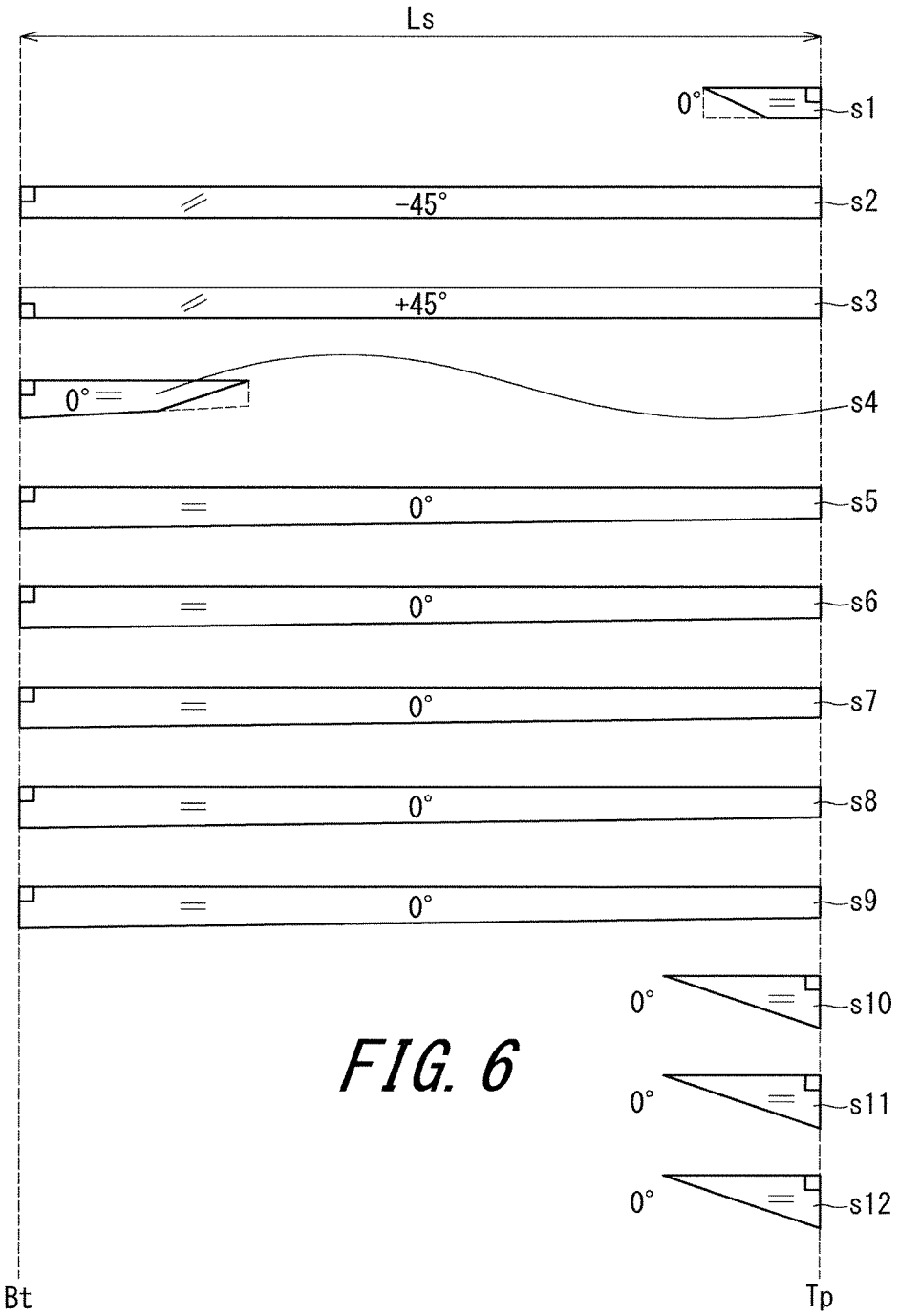
FIG. 6 is a developed view of a shaft according to a reference example 2 (and Comparative Example 2)

FIG. 6 is a developed view showing a laminated constitution of reference example 2. As compared with the embodiment of FIG. 2, the full length hoop layer s3 is not present in the reference example 2. Furthermore, in the reference example 2, the full length straight layers s6 and s8 are disposed instead of the full length hoop layers s7 and s9 of the embodiment of FIG. 2.

In the present application, a weight of the hoop layer is defined as WF (g). A shaft weight is defined as WS (g). Preferably, WF/WS is considered.

In the present application, a point 200 mm distant from the butt end Bt is defined as P1 (See FIG. 1). A region between the point P1 and the butt end is defined as a specific butt region Rb. A weight of the hoop layer in the specific butt region Rb is defined as WFb (g). A shaft weight in the specific butt region Rb is defined as WSb (g). WSb is measured by measuring a weight of a member obtained by cutting the shaft 6 at the point P1. Preferably, WFb/WSb is considered.

As mentioned above, in light of the crushing rigidity, the hoop layer is used. The hoop layer itself is a common knowledge. It is also known that the hoop layer contributes to the strength of a shaft. However, it is considered that the hoop layer does not make a direct contribution to a flexural strength because the hoop layer is a layer, fibers of which are oriented perpendicular to the axis direction of the shaft. In view of the orientation of the fibers, it is naturally considered that it is a straight layer that makes a great contribution to the flexural strength, and the hoop layer merely plays a supplemental function.

In an ultra-lightweight shaft having a shaft weight WS of equal to or less than 42 g, the using amount of prepreg is limited. Thus, a weight WT of the straight layer that has a great contribution to the flexural strength is limited and therefore the flexural strength is apt to be deteriorated. It was a common technical knowledge for a person ordinarily skilled in the art that, in the lightweight shaft, if the hoop layer is excessively increased, the weight WT of the straight layer is further limited to deteriorate the flexural strength.

Nevertheless, the inventor of the present application diligently studied and has found that, in an ultra-lightweight shaft having a weight of equal to or less than 42 g, the flexural strength can be improved by an amount of hoop layer which is considered as excessively great. Specifically, the inventor has found that setting WF/WS to equal to or greater than 0.18 is effective. It has been considered that in an ultra-lightweight shaft having a full length bias layer and a full length straight layer, and reinforced by a tip partial layer, a weight for allocating to the hoop layer is limited. However, it has been found that 18% by weight or greater of the hoop layer improves the flexural strength.

In this respect, WF/WS is preferably equal to or greater than 0.18, more preferably equal to or greater than 0.19, still more preferably equal to or greater than 0.20, and yet still more preferably equal to or greater than 0.21. In light of preventing the weight WT of the straight layer from being excessively small, WF/WS is preferably equal to or less than 0.40, more preferably equal to or less than 0.38, and still more preferably equal to or less than 0.35.

In light of enhancing the flexural strength over the whole shaft, the number of plies of the full length hoop layer is preferably equal to or greater than 2, and more preferably equal to or greater than 3. In light of preventing the weight WT of the straight layer from being excessively small, the number of plies of the full length hoop layer is preferably equal to or less than 5, and more preferably equal to or less than 4.

Is has been found that the hoop layer present in the specific butt region Rb can be further increased. As is clear from the orientation of fibers, the hoop layer makes hardly any contribution to the flexural rigidity. Thus, by disposing a large amount of hoop layer on the butt portion of the shaft, the strength of the butt portion can be improved while the flexural rigidity of the butt portion is suppressed. The cock-analogous effect (to be described later) is enhanced by suppressing the flexural rigidity of the butt portion. In addition, by disposing a large amount of the hoop layer on the butt portion of the shaft, the ratio of the center of gravity of the shaft can be enhanced while the flexural rigidity of the butt portion is suppressed.

In this respect, WFb/WSb is preferably equal to or greater than 0.30, more preferably equal to or greater than 0.32, and still more preferably equal to or greater than 0.35. In light of preventing the straight layer in the specific butt region Rb from being excessively small, WFb/WSb is preferably equal to or less than 0.55, more preferably equal to or less than 0.50, and still more preferably equal to or less than 0.45.

In light of obtaining the above effects by enhancing WFb/WSb, the specific butt region Rb preferably includes the hoop layer of three plies or more, and more preferably the hoop layer of four plies or more. In the embodiment of FIG. 2, the specific butt region Rb includes the hoop layer of four plies. In the embodiment of FIG. 3, the specific butt region Rb includes the hoop layer of three plies. In the embodiment of FIG. 4, the specific butt region Rb includes the hoop layer of three plies. Meanwhile, in the embodiment of FIG. 5, the specific butt region Rb includes the hoop layer of two plies. In the embodiment of FIG. 6, the specific butt region Rb does not include a hoop layer. In view of the limitation of weight in the ultra-lightweight shaft, the number of plies of the hoop layer included in the specific butt region Rb is preferably equal to or less than 6, and more preferably equal to or less than 5.

The term "ply" in the present application means the number of windings. One layer wound over 360° is one ply.

As mentioned above, in the embodiment of FIG. 2, the specific butt region Rb includes the hoop layer of four plies. In the embodiment of FIG. 2, sheets are different from ply to ply. That is, in the specific butt region Rb, the number of wound hoop sheets coincides with the number of plies. As such, one hoop sheet may one ply. Meanwhile, for example, one hoop sheet may two plies.

In light of enhancing WFb/WSb while suppressing the shaft weight WS, the shaft 6 preferably includes a hoop layer that is a butt partial layer (butt partial hoop layer). In the embodiment of FIG. 3, the sheet s5 is the butt partial hoop layer.

In the shaft 6, a weight of the straight layer is defined as WT. Preferably, WF/WT is considered in the present application.

As mentioned above, the present invention has found that an amount of hoop layer that is considered as excessively great can improve the flexural strength in an ultra-lightweight shaft having a weight of equal to or less than 42 g. It is necessary to reduce a straight layer or a bias layer with increase of the hoop layer in order to maintain the lightness of the shaft. In this case, it has been considered that reducing the straight layer deteriorates the flexural strength. However, it has been found that the strength can be improved even when the hoop layer is increased and a straight layer is reduced. This effect is also referred to as an excessive hoop effect. The reason why the excessive hoop effect develops has not been known.

In view of compatibility between lightness and the improvement of strength by the excessive hoop effect, WF/WT is preferably equal to or greater than 0.25, more preferably equal to or greater than 0.35, and still more preferably equal to or greater than 0.45. In light of preventing WT from being excessively small, WF/WT is preferably equal to or less than 0.70, more preferably equal to or less than 0.65, and still more preferably equal to or less than 0.60.

As mentioned above, the present invention is effective in an ultra-lightweight shaft. In this respect, the shaft weight WS is preferably equal to or less than 42 g, more preferably equal to or less than 41 g, still more preferably equal to or less than 40 g, and yet still more preferably equal to or less than 39 g. In light of strength, the shaft weight WS is preferably equal to or greater than 30 g, more preferably equal to or greater than 32 g, and still more preferably equal to or greater than 34 g.

Preferably, an inner diameter of the shaft at the point P1 is considered.

A grip to be attached can be lightweight by increasing an outer diameter of the butt portion of the shaft. This is because, under a condition in which outer diameters of grips attached to shafts are equal, the greater the outer diameter of the shaft is, the smaller the wall thickness of the grip is. Weight reduction of the grip leads to weight reduction of the club. In an ultra-lightweight shaft, although a wall thickness of the shaft itself is small, an outer diameter of the shaft can be increased by increasing the inner diameter of the shaft.

However, when the inner and outer diameter of the shaft becomes greater, the flexural rigidity is increased. Therefore, if the inner and outer diameter of the butt portion of the shaft is increased, bending (flexural deformation) of the butt portion is reduced and the cock-analogous effect (to be described later) is deteriorated.

Consequently, in the present embodiment, a proportion of the hoop layer in the specific butt region Rb is increased. Thus, the flexural rigidity in the butt portion is suppressed. That is, the bending of the butt portion is secured by increasing the proportion of the hoop layer even when the butt portion is made large. As a result, the weight of the grip can be reduced and the bending of the butt portion is secured. The weight reduction of the club associated with the weight reduction of the grip contributes to improvement in head speed. Since the effect of the bending of the butt portion (cock-analogous effect) is added to this effect, the head speed can be further improved In this respect, the inner diameter of the shaft at the point P1 is preferably equal to or greater than 14.0 mm, more preferably equal to or greater than 14.1 mm, still more preferably equal to or greater than 14.2 mm, and yet still more preferably equal to or greater than 14.3 mm. In light of suppressing an excessively great flexural rigidity in the butt portion, the inner diameter of the shaft at the point P1 is preferably equal to or less than 16 mm, more preferably equal to or less than 15.8 mm, and still more preferably equal to or less than 15.6 mm.

In the same respect, the outer diameter of the shaft at the point P1 is preferably equal to or greater than 15.0 mm, more preferably equal to or greater than 15.1 mm, still more preferably equal to or greater than 15.2 mm, and yet still more preferably equal to or greater than 15.3 mm. In light of suppressing an excessively great flexural rigidity in the butt portion, the outer diameter of the shaft at the point P1 is preferably equal to or less than 18 mm, more preferably equal to or less than 17.8 mm, and still more preferably equal to or less than 17.6 mm.

The specific butt region Rb of the shaft 6 has a tapered shape which becomes thinner toward the head side. That is, the outer diameter of the shaft 6 in the specific butt region Rb is greater as being closer to the butt end Bt. Thus, the grip weight can be further reduced.

A lightweight shaft has a small wall thickness. However, the outer diameter in the butt portion can be increased by increasing the inner diameter of the shaft in the butt portion even when the wall thickness is small. In this respect, the wall thickness of the shaft in the specific butt region Rb is preferably equal to or less than 0.70 mm, more preferably equal to or less than 0.60 mm, and still more preferably equal to or less than 0.56 mm. In light of strength, the wall thickness of the shaft in the specific butt region Rb is preferably equal to or greater than 0.30 mm, more preferably equal to or greater than 0.35 mm, and still more preferably equal to or greater than 0.40 mm.

In the present application, an EI value is measured at each position on the shaft. The EI value is an index showing a flexural rigidity.

[Measurement of EI Value]

Figure 7:
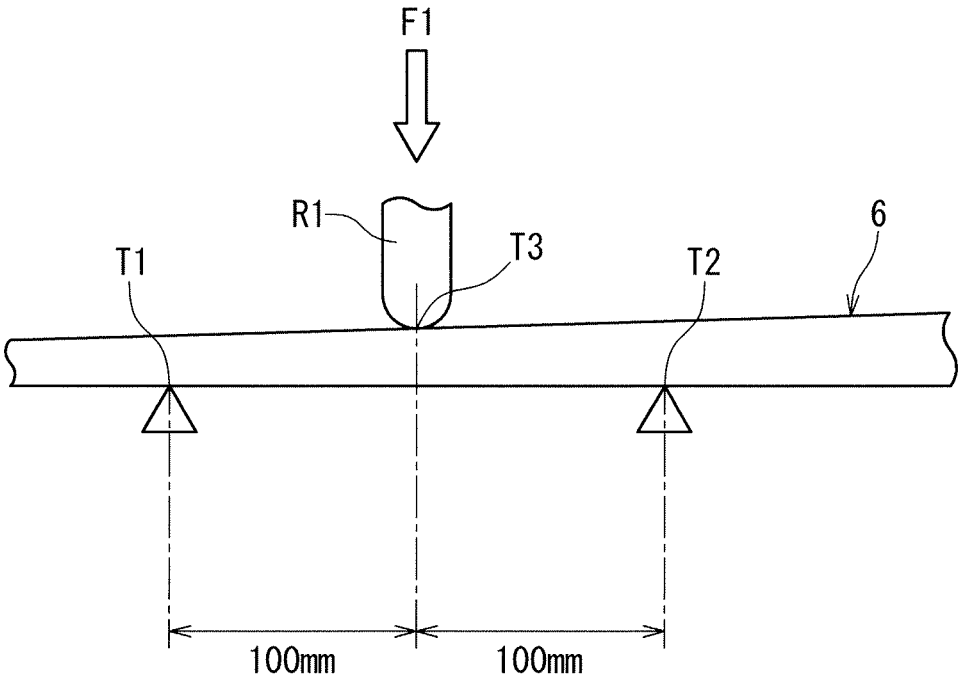
FIG. 7 is a schematic view showing a method for measuring an EI value.

FIG. 7 shows a method for measuring the EI value. EI is measured using a universal material testing machine, Type 2020 (maximum load: 500 kg) manufactured by INTESCO Co., Ltd. The shaft 6 is supported from beneath at a first support point T1 and a second support point T2. A load F1 is applied from above to a measurement point T3 while keeping the supports. The direction of the load F1 is the vertically downward direction. The distance between the point T1 and the point T2 is 200 mm. The measurement point T3 is set to a position by which the distance between the point T1 and the point T2 is divided into two equal parts. A deflection amount H generated by applying the load F1 is measured. The load F1 is applied with an indenter R1. The tip of the indenter R1 is a cylindrical surface having a curvature radius of 5 mm. A downwardly moving speed of the indenter R1 is 5 ram/min. The moving of the indenter R1 is stopped when the load F1 reaches 20 kgf (196 N), and the deflection amount H at the time is measured. The deflection amount H is the amount of displacement of the point T3 in the vertical direction. The EI value is calculated by the following formula:

$$EI\ (kgf \cdot m^2) = F1 \times L^3/(48 \times H),$$

where F1 represents the maximum load (kgf), L represents the distance between the support points (m), and H represents the deflection amount (m). The maximum load F1 is 20 kgf, and the distance L between the support points is 0.2 m.

[E1 to E10]

The following ten points are exemplified as the measurement points of EI.

(Measurement point 1): a point 130 mm distant from the tip end Tp (Measurement point 2): a point 230 mm distant from the tip end Tp (Measurement point 3): a point 330 mm distant from the tip end Tp (Measurement point 4): a point 430 mm distant from the tip end Tp (Measurement point 5): a point 530 mm distant from the tip end Tp (Measurement point 6): a point 630 mm distant from the tip end Tp (Measurement point 7): a point 730 mm distant from the tip end Tp (Measurement point 8): a point 830 mm distant from the tip end Tp (Measurement point 9): a point 930 mm distant from the tip end Tp (Measurement point 10): a point 1030 mm distant from the tip end Tp In the present application, an EI value at the measurement point 1 is defined as E1. An EI value at the measurement point 2 is defined as E2. An EI value at the measurement point 3 is defined as E3. An EI value at the measurement point 4 is defined as E4. An EI value at the measurement point 5 is defined as E5. An EI value at the measurement point 6 is defined as E6. An EI value at the measurement point 7 is defined as E7. An EI value at the measurement point 8 is defined as E8. An EI value at the measurement point 9 is defined as E9. An EI value at the measurement point 10 is defined as E10.

As mentioned above, head speed can be improved by suppressing the flexural rigidity of the butt portion. In this respect, the EI value E10 at the point 1030 mm distant from the tip end Tp is preferably equal to or less than 5.0 ($kgf \cdot m^2$), more preferably equal to or less than 4.5 ($kgf \cdot m^2$), still more preferably equal to or less than 4.3 ($kgf \cdot m^2$), and yet still more preferably equal to or less than 4.0 ($kgf \cdot m^2$). If E10 is excessively small, return from the bending becomes insufficient to deteriorate the head speed. In this respect, E10 is preferably equal to or greater than 2.8 ($kgf \cdot m^2$), more preferably equal to or greater than 3.0 ($kgf \cdot m^2$), and still more preferably equal to or greater than 3.2 ($kgf \cdot m^2$).

As for distribution of rigidity, a gradient M3 is preferably considered. The gradient M3 is calculated based on the above described E8, E9 and E10. In a graph obtained by plotting the three EI values (E8, E9, E10) on an x-y coordinate plane in which the x axis represents a distance (mm) between the tip end Tp and a measurement point and the y axis represents the EI value ($kgf \cdot m^2$), a gradient of a linear expression obtained by approximating the three points with a least-square method is defined as M3.

The butt portion of the shaft is easy to bend in the initial phase of a downswing by making the gradient M3 gentle. As a result, the head speed is improved. In this respect, the gradient M3 is preferably equal to or less than 0.0100, more preferably equal to or less than 0.0080, and still more preferably equal to or less than 0.0050. When the gradient M3 is excessively small, the flexural rigidity of the butt portion is excessively small and return from the bending may be insufficient. In this respect, the gradient M3 is preferably equal to or greater than 0.0039, more preferably equal to or greater than 0.0040, and still more preferably equal to or greater than 0.0041.

In the present application, a graph prepared based on a plurality of EI values is considered. The graph is an x-y coordinate plane. The x axis of the graph represents a distance (mm) between the tip end Tp and the measurement point. The y axis of the graph represents the EI value ($kgf \cdot m^2$). An example of the graph is shown in FIG. 8.

Figure 8:
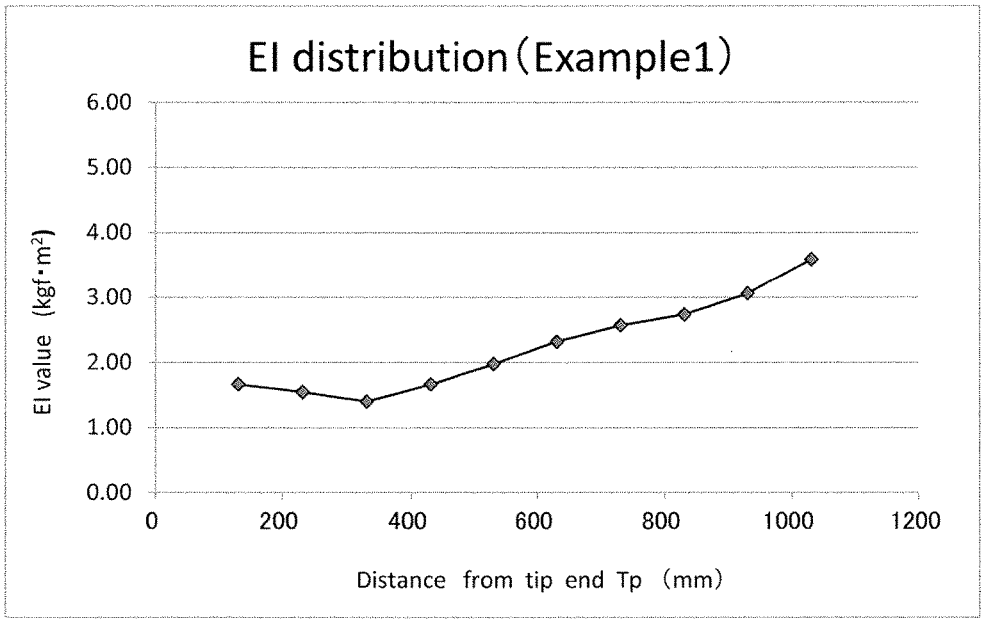
FIG. 8 is a graph obtained by plotting E1 to E10 of Example 1.

FIG. 8 is a graph on which E1 to E10 of Example 1 (to be described later) are plotted. Coordinates (x, y) of the ten points plotted on the graph are (130, E1), (230, E2), (330, E3), (430, E4), (530, E5), (630, E6), (730, E7), (830, E8), (930, E9) and (1030, E10).

As for the distribution of rigidity, a gradient M1 and a gradient M2 can be considered. M1 is a gradient of a straight line passing through (130, E1) and (230, E2). M2 is a gradient of a straight line obtained by approximating the five points (330, E3), (430, E4), (530, E5), (630, E6), and (730, E7) with the least-square method. As mentioned above, M3 is gradient of a straight line obtained by approximating the three points (830, E8), (930, E9) and (1030, E10) with the least-square method.

The approximation for forming a straight line with the least-square method can be easily performed by using the function of "linear approximation" in the spreadsheet program "EXCEL 2010" manufactured by Microsoft Corporation. The function "LINEST" in the program may be used. The trade name "EXCEL" is a registered trademark of Microsoft Corporation.

In the case of FIG. 8, the gradient M1 is −0.0013, the gradient M2 is 0.0028 and the gradient M3 is 0.0043.

The return from the bending is enhanced by bending the middle portion of the shaft and securing the amount of the bending to improve the head speed. In addition, as mentioned above, bending at the butt portion is increased by suppressing the gradient M3 to accelerate the head speed. In these respects, M1, M2 and M3 preferably satisfy the following.

(a) $-0.015 \leq M1 \leq 0$ (b) $0.0008 \leq M2 \leq 0.0080$ (c) $0.0040 \leq M3 \leq 0.0100$ (d) $M2 < M3$ That is, the gradient M1 is preferably equal to or greater than −0.015 but preferably equal to or less than 0. The gradient M2 is preferably equal to or greater than 0.0008 but preferably equal to or less than 0.0080. The gradient M3 is preferably equal to or greater than 0.0040 but preferably equal to or less than 0.0100. M3 is preferably greater than M2.

In general, cock is maintained in a first half phase of the downswing. The cock means bend of wrists. In a person ordinarily skilled in the art, maintaining the cock also referred to as "cock is held". In order to enhance the head speed, it is preferable that the cock is maintained until immediately before an impact and cock is released immediately before the impact. However, amateur golf players release the cock too early and therefore the head speed is low.

The butt portion of the shaft is bent in the initial phase of the downswing by optimizing the distribution of the flexural rigidity. Thus, the condition is similar to the situation where the cock is held. By releasing the bending immediately before the impact, the head speed can be improved as when the cock is released. This effect is also referred to as the cock-analogous effect. The release of the bending is also referred to as "return from bending".

In the initial phase of a downswing (immediately after a turn from the top), a flexural stress is applied particularly to the butt side of the shaft. By suppressing E10 and decreasing the gradient M3, the bending of the butt portion in the initial phase of the downswing is increased. The increase of the bending enhances the cock-analogous effect.

Furthermore, in the present embodiment, easiness of swing is achieved since the ratio of the center of gravity of the shaft is high. Therefore, the head speed is further improved.

As mentioned above, a hoop layer is used as a butt partial layer. Therefore, the rigidity of the butt portion is suppressed and the cock-analogous effect is enhanced. Furthermore, the butt partial layer contributes to increase in the ratio of the center of gravity of the shaft.

The butt partial layer tends to have an effect on feeling since the butt partial layer is close to the grip. The hoop layer does not include a fiber oriented in the axis direction. In the hoop layer, a matrix resin is present between fibers oriented in the circumferential direction, and thereby vibration conveyed in the axis direction tends to be absorbed by the matrix resin. As a result, feel in hitting can be improved by the butt partial hoop layer. In addition, it is considered that a good bending in the butt portion contributes to improvement of feeling.

Examples of design items for adjusting E1 to E10 and the gradients M1 to M3 include the following (a1) to (a8). A desirable shaft can be obtained by setting these items appropriately.

(a1) a taper ratio of the shaft (mandrel)

(a2) an axial-direction length of the tip partial layer (a3) a thickness of the tip partial layer (a4) a fiber elastic modulus of the tip partial layer (a5) an axial-direction length of the butt partial layer (a6) a thickness of the butt partial layer (a7) a fiber elastic modulus of the butt partial layer (a8) an axial-direction position of a partial layer Examples of means for adjusting the ratio of the center of gravity of the shaft include the following (b1) to (b6). A desirable shaft can be obtained by setting these items appropriately.

(b1) a thickness of the butt partial layer (b2) an axial-direction length of the butt partial layer (b3) a thickness of the tip partial layer (b4) an axial-direction length of the tip partial layer (b5) a taper ratio of the shaft (mandrel)

(b6) a shape of each sheet

The following tables 1 and 2 show examples of utilizable prepregs. These prepregs are commercially available. Appropriate prepregs can be selected to obtain desired specifications.

TABLE 1

Examples of utilizable prepregs

| | | | | | Physical property value of reinforcement fiber | | |
|---|---|---|---|---|---|---|---|
| Manufacturer | Trade name | Thickness of sheet (mm) | Fiber content (% by weight) | Resin content (% by weight) | Part number of fiber | Tensile elastic modulus (t/mm$^2$) | Tensile strength (kgf/mm$^2$) |
| Toray Industries, Inc. | 3255S-10 | 0.082 | 76 | 24 | T700S | 24 | 500 |
| Toray Industries, Inc. | 3255S-12 | 0.103 | 76 | 24 | T700S | 24 | 500 |
| Toray Industries, Inc. | 3255S-15 | 0.123 | 76 | 24 | T700S | 24 | 500 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Toray Industries, Inc. | 2276S-10 | 0.077 | 80 | 20 | T800S | 30 | 600 |
| Toray Industries, Inc. | 805S-3 | 0.034 | 60 | 40 | M30S | 30 | 560 |
| Toray Industries, Inc. | 8053S-3 | 0.028 | 70 | 30 | M30S | 30 | 560 |
| Toray Industries, Inc. | 9255S-7A | 0.056 | 78 | 22 | M40S | 40 | 470 |
| Toray Industries, Inc. | 9255S-6A | 0.047 | 76 | 24 | M40S | 40 | 470 |
| Toray Industries, Inc. | 925AS-4C | 0.038 | 65 | 35 | M40S | 40 | 470 |
| Toray Industries, Inc. | 9053S-4 | 0.027 | 70 | 30 | M40S | 40 | 470 |
| Toray Industries, Inc. | 17045G-10 | 0.082 | 76 | 24 | T1100G | 33 | 675 |
| Nippon Graphite Fiber Corporation | E1026A-09N | 0.100 | 63 | 37 | XN-10 | 10 | 190 |
| Nippon Graphite Fiber Corporation | E1026A-14N | 0.150 | 63 | 37 | XN-10 | 10 | 190 |

The tensile strength and the tensile elastic modulus are measured in accordance with "Testing Method for Carbon Fibers" JIS R7601:1986.

TABLE 2

| Examples of utilizable prepregs | | | | | | | |
|---|---|---|---|---|---|---|---|
| | | | | | Physical property value of reinforcement fiber | | |
| Manufacturer | Trade name | Thickness of sheet (mm) | Fiber content (% by weight) | Resin content (% by weight) | Part number of fiber | Tensile elastic modulus ($t/mm^2$) | Tensile strength ($kgf/mm^2$) |
| Mitsubishi Rayon Co., Ltd. | GE352H-160S | 0.150 | 65 | 35 | E glass | 7 | 320 |
| Mitsubishi Rayon Co., Ltd. | TR350C-100S | 0.083 | 75 | 25 | TR50S | 24 | 500 |
| Mitsubishi Rayon Co., Ltd. | TR350U-100S | 0.078 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | TR350C-175S | 0.147 | 75 | 25 | TR50S | 24 | 500 |
| Mitsubishi Rayon Co., Ltd. | MR350J-025S | 0.034 | 63 | 37 | MR40 | 30 | 450 |
| Mitsubishi Rayon Co., Ltd. | MR350J-050S | 0.058 | 63 | 37 | MR40 | 30 | 450 |
| Mitsubishi Rayon Co., Ltd. | MR350C-050S | 0.05 | 75 | 25 | MR40 | 30 | 450 |
| Mitsubishi Rayon Co., Ltd. | MR350C-075S | 0.063 | 75 | 25 | MR40 | 30 | 450 |
| Mitsubishi Rayon Co., Ltd. | MRX350C-075R | 0.063 | 75 | 25 | MR40 | 30 | 450 |
| Mitsubishi Rayon Co., Ltd. | MRX350C-100S | 0.085 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MRX350C-125S | 0.105 | 75 | 25 | MR40 | 30 | 450 |
| Mitsubishi Rayon Co., Ltd. | MR350C-125S | 0.105 | 75 | 25 | MR40 | 30 | 450 |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

The tensile strength and the tensile elastic modulus are measured in accordance with "Testing Method for Carbon Fibers" JIS R7601:1986.

EXAMPLES

Hereinafter, the effects of the present invention will be clarified by examples. However, the present invention should not be interpreted in a limited way based on the description of examples.

Example 1

A shaft having the laminated constitution shown in FIG. 2 was produced. The shaft of Example 1 was obtained in the same manner as in the manufacturing process of the shaft 6. Specifications were adjusted by using the above described design items. Prepregs used for the sheets were as follows. The axial-direction length Fb of the butt partial hoop layer s5 was 270 mm.

Sheet s1: A glass fiber reinforced prepreg (having a fiber elastic modulus of 7 $tf/mm^2$)

Sheet s2: A carbon fiber reinforced prepreg (having a fiber elastic modulus of 40 $tf/mm^2$)

Sheet s3: A carbon fiber reinforced prepreg (having a fiber elastic modulus of 30 $tf/mm^2$)

Sheet s4: A carbon fiber reinforced prepreg (having a fiber elastic modulus of 40 $tf/mm^2$)

Sheet s5: A carbon fiber reinforced prepreg (having a fiber elastic modulus of 24 $tf/mm^2$)

Sheet s6: A carbon fiber reinforced prepreg (having a fiber elastic modulus of 24 $tf/mm^2$)

Sheet s7: A carbon fiber reinforced prepreg (having a fiber elastic modulus of 30 $tf/mm^2$)

Sheet s8: A carbon fiber reinforced prepreg (having a fiber elastic modulus of 33 $tf/mm^2$)

Sheet s9: A carbon fiber reinforced prepreg (having a fiber elastic modulus of 30 $tf/mm^2$)

Sheet s10: A carbon fiber reinforced prepreg (having a fiber elastic modulus of 24 $tf/mm^2$)

Sheet s11: A carbon fiber reinforced prepreg (having a fiber elastic modulus of 10 $tf/mm^2$)

Sheet s12: A carbon fiber reinforced prepreg (having a fiber elastic modulus of 24 $tf/mm^2$)

Sheet s13: A carbon fiber reinforced prepreg (having a fiber elastic modulus of 24 $tf/mm^2$)

Ten EI values of Example 1 are shown in Table 3 below. In Example 1, a linear expression obtained by approximating the three points on the graph of E8, E9 and E10 with a least-square method was $y=0.0043x-0.8349$.

Example 2

The shaft of Example 2 was obtained in the same manner as in Example 1 except that the laminated constitution shown in FIG. 3 was adopted. Ten EI values of Example 2 are shown in Table 4 below.

In Example 2, prepregs used for the sheets were as follows.

Sheet s1: A glass fiber reinforced prepreg (having a fiber elastic modulus of 7 tf/mm$^2$)
Sheet s2: A carbon fiber reinforced prepreg (having a fiber elastic modulus of 40 tf/mm$^2$)
Sheet s3: A carbon fiber reinforced prepreg (having a fiber elastic modulus of 40 tf/mm$^2$)
Sheet s4: A carbon fiber reinforced prepreg (having a fiber elastic modulus of 24 tf/mm$^2$)
Sheet s5: A carbon fiber reinforced prepreg (having a fiber elastic modulus of 24 tf/mm$^2$)
Sheet s6: A carbon fiber reinforced prepreg (having a fiber elastic modulus of 24 tf/mm$^2$)
Sheet s7: A carbon fiber reinforced prepreg (having a fiber elastic modulus of 30 tf/mm$^2$)
Sheet s8: A carbon fiber reinforced prepreg (having a fiber elastic modulus of 33 tf/mm$^2$)
Sheet s9: A carbon fiber reinforced prepreg (having a fiber elastic modulus of 30 tf/mm$^2$)
Sheet s10: A carbon fiber reinforced prepreg (having a fiber elastic modulus of 24 tf/mm$^2$)
Sheet s11: A carbon fiber reinforced prepreg (having a fiber elastic modulus of 10 tf/mm$^2$)
Sheet s12: A carbon fiber reinforced prepreg (having a fiber elastic modulus of 24 tf/mm$^2$)
Sheet s13: A carbon fiber reinforced prepreg (having a fiber elastic modulus of 24 tf/mm$^2$)

Example 3

The shaft of Example 3 was obtained in the same manner as in Example 1 except that the laminated constitution shown in FIG. 4 was adopted. Ten EI values of Example 3 are shown in Table 5 below.

In Example 3, prepregs used for the sheets were as follows.

Sheet s1: A glass fiber reinforced prepreg (having a fiber elastic modulus of 7 tf/mm$^2$)
Sheet s2: A carbon fiber reinforced prepreg (having a fiber elastic modulus of 40 tf/mm$^2$)
Sheet s3: A carbon fiber reinforced prepreg (having a fiber elastic modulus of 30 tf/mm$^2$)
Sheet s4: A carbon fiber reinforced prepreg (having a fiber elastic modulus of 40 tf/mm$^2$)
Sheet s5: A carbon fiber reinforced prepreg (having a fiber elastic modulus of 24 tf/mm$^2$)
Sheet s6: A carbon fiber reinforced prepreg (having a fiber elastic modulus of 24 tf/mm$^2$)
Sheet s7: A carbon fiber reinforced prepreg (having a fiber elastic modulus of 30 tf/mm$^2$)
Sheet s8: A carbon fiber reinforced prepreg (having a fiber elastic modulus of 33 tf/mm$^2$)
Sheet s9: A carbon fiber reinforced prepreg (having a fiber elastic modulus of 24 tf/mm$^2$)
Sheet s10: A carbon fiber reinforced prepreg (having a fiber elastic modulus of 24 tf/mm$^2$)
Sheet s11: A carbon fiber reinforced prepreg (having a fiber elastic modulus of 10 tf/mm$^2$)
Sheet s12: A carbon fiber reinforced prepreg (having a fiber elastic modulus of 24 tf/mm$^2$)
Sheet s13: A carbon fiber reinforced prepreg (having a fiber elastic modulus of 24 tf/mm$^2$)

Comparative Example 1

The shaft of Comparative Example 1 was obtained in the same manner as in Example 1 except that the laminated constitution shown in FIG. 5 was adopted. Specifications were adjusted by using the above described design items. Prepregs used for the sheets were as follows.

Sheet s1: A glass fiber reinforced prepreg (having a fiber elastic modulus of 7 tf/mm$^2$)
Sheet s2: A carbon fiber reinforced prepreg (having a fiber elastic modulus of 40 tf/mm$^2$)
Sheet s3: A carbon fiber reinforced prepreg (having a fiber elastic modulus of 40 tf/mm$^2$)
Sheet s4: A carbon fiber reinforced prepreg (having a fiber elastic modulus of 24 tf/mm$^2$)
Sheet s5: A carbon fiber reinforced prepreg (having a fiber elastic modulus of 24 tf/mm$^2$)
Sheet s6: A carbon fiber reinforced prepreg (having a fiber elastic modulus of 24 tf/mm$^2$)
Sheet s7: A carbon fiber reinforced prepreg (having a fiber elastic modulus of 33 tf/mm$^2$)
Sheet s8: A carbon fiber reinforced prepreg (having a fiber elastic modulus of 30 tf/mm$^2$)
Sheet s9: A carbon fiber reinforced prepreg (having a fiber elastic modulus of 24 tf/mm$^2$)
Sheet s10: A carbon fiber reinforced prepreg (having a fiber elastic modulus of 10 tf/mm$^2$)
Sheet s11: A carbon fiber reinforced prepreg (having a fiber elastic modulus of 24 tf/mm$^2$)
Sheet s12: A carbon fiber reinforced prepreg (having a fiber elastic modulus of 24 tf/mm$^2$)

Ten EI values of Comparative Example 1 are shown in Table 6 below.

Comparative Example 2

The shaft of Comparative Example 2 was obtained in the same manner as in Example 1 except that the laminated constitution shown in FIG. 6 was adopted. Specifications were adjusted by using the above described design items. Prepregs used for the sheets were as follows.

Sheet s1: A glass fiber reinforced prepreg (having a fiber elastic modulus of 7 tf/mm$^2$)
Sheet s2: A carbon fiber reinforced prepreg (having a fiber elastic modulus of 40 tf/mm$^2$)
Sheet s3: A carbon fiber reinforced prepreg (having a fiber elastic modulus of 40 tf/mm$^2$)
Sheet s4: A carbon fiber reinforced prepreg (having a fiber elastic modulus of 24 tf/mm$^2$)
Sheet s5: A carbon fiber reinforced prepreg (having a fiber elastic modulus of 24 tf/mm$^2$)
Sheet s6: A carbon fiber reinforced prepreg (having a fiber elastic modulus of 24 tf/mm$^2$)
Sheet s7: A carbon fiber reinforced prepreg (having a fiber elastic modulus of 33 tf/mm$^2$)
Sheet s8: A carbon fiber reinforced prepreg (having a fiber elastic modulus of 24 tf/mm$^2$)
Sheet s9: A carbon fiber reinforced prepreg (having a fiber elastic modulus of 24 tf/mm$^2$)
Sheet s10: A carbon fiber reinforced prepreg (having a fiber elastic modulus of 10 tf/mm$^2$)
Sheet s11: A carbon fiber reinforced prepreg (having a fiber elastic modulus of 24 tf/mm$^2$)

Sheet s12: A carbon fiber reinforced prepreg (having a fiber elastic modulus of 24 tf/mm$^2$)

Ten EI values of Comparative Example 2 are shown in Table 7 below.

Comparative Example 3

The shaft of Comparative Example 3 was obtained in the same manner as in Comparative Example 2 except that the fiber elastic modulus of the butt partial straight layer s4 is changed to 40t.

Specifications and results of evaluations for Examples 1 to 3 and Comparative Examples 1 to 3 are shown in Table 8 below.

Table 9 below shows the inner diameter and the outer diameter at each position of the shaft in Example 1. The shaft full length Ls of the shaft in Example 1 is 1175 mm.

TABLE 3

EI values of Example 1

| | Distance from the tip end (mm) | EI value (kgf · m$^2$) |
|---|---|---|
| E1 | 130 | 1.66 |
| E2 | 230 | 1.54 |
| E3 | 330 | 1.39 |
| E4 | 430 | 1.66 |
| E5 | 530 | 1.97 |
| E6 | 630 | 2.32 |
| E7 | 730 | 2.56 |
| E8 | 830 | 2.73 |
| E9 | 930 | 3.06 |
| E10 | 1030 | 3.58 |

TABLE 4

EI values of Example 2

| | Distance from the tip end (mm) | EI value (kgf · m$^2$) |
|---|---|---|
| E1 | 130 | 1.65 |
| E2 | 230 | 1.55 |
| E3 | 330 | 1.41 |
| E4 | 430 | 1.68 |
| E5 | 530 | 2.00 |
| E6 | 630 | 2.36 |
| E7 | 730 | 2.62 |
| E8 | 830 | 2.89 |
| E9 | 930 | 3.13 |
| E10 | 1030 | 3.66 |

TABLE 5

EI values of Example 3

| | Distance from the tip end (mm) | EI value (kgf · m$^2$) |
|---|---|---|
| E1 | 130 | 1.79 |
| E2 | 230 | 1.76 |
| E3 | 330 | 1.63 |
| E4 | 430 | 1.94 |
| E5 | 530 | 2.32 |
| E6 | 630 | 2.72 |
| E7 | 730 | 3.03 |
| E8 | 830 | 3.34 |
| E9 | 930 | 3.64 |
| E10 | 1030 | 4.24 |

TABLE 6

EI values of Comparative Example 1

| | Distance from the tip end (mm) | EI value (kgf · m$^2$) |
|---|---|---|
| E1 | 130 | 1.79 |
| E2 | 230 | 1.75 |
| E3 | 330 | 1.62 |
| E4 | 430 | 1.93 |
| E5 | 530 | 2.30 |
| E6 | 630 | 2.71 |
| E7 | 730 | 3.01 |
| E8 | 830 | 3.33 |
| E9 | 930 | 3.61 |
| E10 | 1030 | 5.10 |

TABLE 7

EI values of Comparative Example 2

| | Distance from the tip end (mm) | EI value (kgf · m$^2$) |
|---|---|---|
| E1 | 130 | 1.90 |
| E2 | 230 | 1.91 |
| E3 | 330 | 1.81 |
| E4 | 430 | 2.16 |
| E5 | 530 | 2.58 |
| E6 | 630 | 3.04 |
| E7 | 730 | 3.39 |
| E8 | 830 | 3.75 |
| E9 | 930 | 4.38 |
| E10 | 1030 | 5.58 |

TABLE 8

Specifications and results of evaluations for Examples and Comparative Examples

| | Ex. 1 | Ex. 2 | Ex. 3 | Comp. Ex. 1 | Comp. Ex. 2 | Comp. Ex. 3 |
|---|---|---|---|---|---|---|
| Shaft weight WS (g) | 39 | 39 | 39 | 39 | 39 | 39 |
| Ratio of the center of gravity of the shaft | 0.52 | 0.51 | 0.50 | 0.50 | 0.50 | 0.50 |
| The number of plies of the full length hoop layer | 3 | 2 | 2 | 1 | 0 | 0 |
| The number of plies of the hoop layer in the specific butt region | 4 | 3 | 3 | 2 | 0 | 0 |
| Angle (degree) of fibers of the butt partial layer | 90 | 90 | 90 | 90 | 0 | 0 |
| WF/WS | 0.24 | 0.24 | 0.19 | 0.14 | 0 | 0 |
| WFb/WSb | 0.40 | 0.34 | 0.30 | 0.27 | 0 | 0 |
| WF/WT | 0.46 | 0.34 | 0.25 | 0.20 | 0 | 0 |
| Gradient M1 | −0.0013 | −0.0012 | −0.0008 | −0.0008 | −0.0005 | −0.0005 |
| Gradient M2 | 0.0028 | 0.0031 | 0.0035 | 0.0035 | 0.004 | 0.004 |
| Gradient M3 | 0.0043 | 0.0039 | 0.0045 | 0.0089 | 0.0091 | 0.0125 |
| E10 (kgf · m$^2$) | 3.58 | 3.66 | 4.24 | 5.10 | 5.58 | 6.25 |
| Strength at B point (kgf) | 70 | 68 | 65 | 63 | 62 | 62 |

TABLE 8-continued

Specifications and results of evaluations for Examples and Comparative Examples

| | Ex. 1 | Ex. 2 | Ex. 3 | Comp. Ex. 1 | Comp. Ex. 2 | Comp. Ex. 3 |
|---|---|---|---|---|---|---|
| Strength at C point (kgf) | 100 | 98 | 95 | 90 | 88 | 80 |
| Head speed (m/s) | 38 | 37.5 | 37.5 | 37 | 36.5 | 36 |
| Feeling (maximum scale of 5 points) | 5 | 4 | 4 | 3 | 2 | 1 |

TABLE 9

Inner diameters and outer diameters in Example 1

| Distance (mm) from the tip end Tp | Outer diameter (mm) | Inner diameter (mm) | Thickness (mm) |
|---|---|---|---|
| 0 | 9.00 | 6.16 | 1.42 |
| 50 | 9.02 | 6.40 | 1.31 |
| 100 | 9.05 | 7.05 | 1.00 |
| 150 | 9.19 | 7.70 | 0.75 |
| 200 | 9.47 | 8.13 | 0.67 |
| 250 | 9.75 | 8.56 | 0.59 |
| 300 | 10.03 | 8.98 | 0.52 |
| 350 | 10.44 | 9.41 | 0.51 |
| 400 | 10.84 | 9.85 | 0.49 |
| 450 | 11.26 | 10.27 | 0.49 |
| 500 | 11.68 | 10.70 | 0.49 |
| 550 | 12.09 | 11.13 | 0.48 |
| 600 | 12.51 | 11.56 | 0.47 |
| 650 | 12.94 | 11.99 | 0.48 |
| 700 | 13.37 | 12.41 | 0.48 |
| 750 | 13.78 | 12.84 | 0.47 |
| 800 | 14.20 | 13.27 | 0.46 |
| 850 | 14.61 | 13.70 | 0.45 |
| 900 | 14.98 | 14.09 | 0.44 |
| 950 | 15.36 | 14.37 | 0.49 |
| Point P1 | 15.53 | 14.51 | 0.51 |
| 1000 | 15.70 | 14.66 | 0.52 |
| 1050 | 15.96 | 14.89 | 0.53 |
| 1100 | 16.11 | 15.03 | 0.54 |
| 1150 | 16.24 | 15.16 | 0.54 |
| Butt end Bt | 16.31 | 15.23 | 0.54 |

Methods for the evaluations are as follows.

[Three-Point Flexural Strength]

Three-point flexural strength was measured in accordance with an SG type three-point flexural strength test. This is a test set by Japan's Consumer Product Safety Association. Measurement points were set to a point B and a point C. The point B is a point 525 mm distant from the tip end Tp. The point C is a point 175 mm distant from the butt end Bt.

Figure 9:
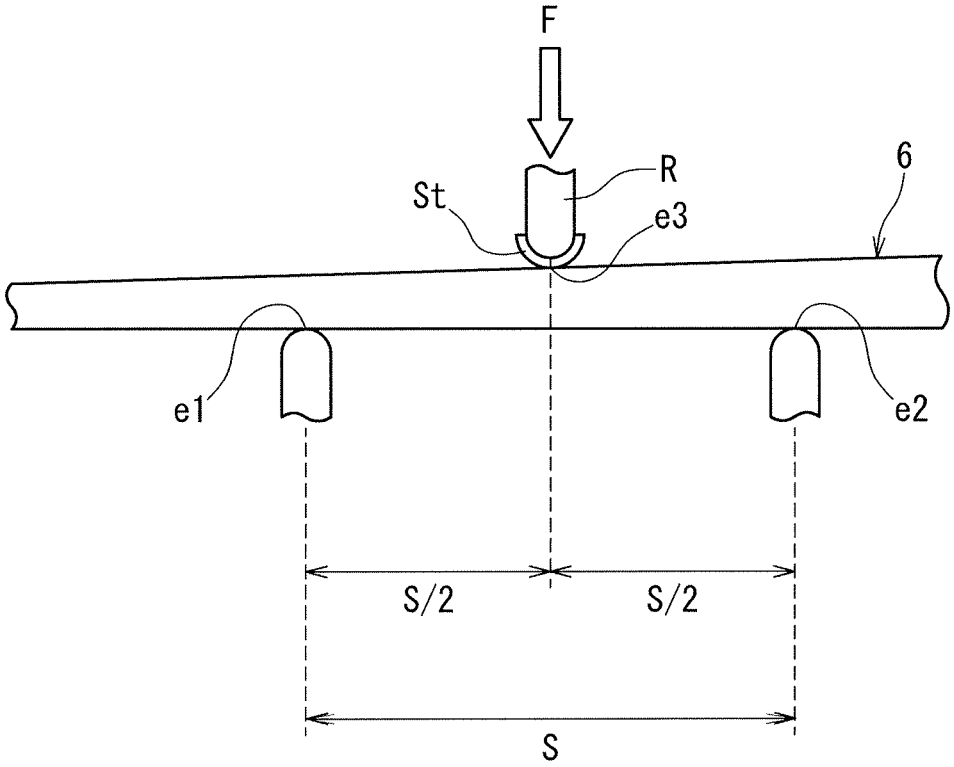
FIG. 9 is a schematic view showing a method for measuring a three-point flexural strength.

FIG. 9 shows a method for measuring the three-point flexural strength. As shown in FIG. 9, a load F is downwardly applied with an indenter R from above to a load point e3 while the shaft 6 is being supported from beneath at two supporting points e1 and e2. The descending speed of the indenter R is 20 mm/min. A silicone rubber St was attached to the tip of the indenter R. The position of the load point e3 is set to a position by which a distance between the support points e1 and e2 is divided into two equal parts. The load point e3 is the measurement point. When the points B and C are measured, a span S is set to 300 mm. A value (peak value) of the load F when the shaft 6 was broken was measured. Values of the load F are shown in the above Table 8.

[Feeling]

A head and a grip were attached to each shaft to obtain golf clubs. A driver head (loft 10.5 degrees), the trade name "XXIO NINE" manufactured by Dunlop Sports Co., Ltd., was used as the head. Ten golf players actually hit balls with the golf clubs and evaluated the feelings. The feeling was defined as an overall evaluation of feel in hitting and easiness of swing. Sensuous evaluation was made on a scale of one to five. The higher the score is, the higher the evaluation is. The average scores of the ten golf players are shown in the above Table 8.

As shown in Table 8, Examples are highly evaluated as compared with Comparative Examples.

As shown in Table 9, in the shaft of Example 1, although the wall thickness in the specific butt region is as thin as 0.6 mm or less, the inner diameter in the specific butt region Rb is great, and therefore a great outer diameter is secured in the region Rb. Thus, the wall thickness of the grip can be decreased and the weight of the club can be reduced. In addition, in Example 1, even though the inner and outer diameters of the shaft in the specific butt region Rb is great, E10 is small because of a great WFb/WSb. Therefore, bending of the butt portion is secured and the head speed is great.

As described above, the advantages of the present invention are apparent.

The invention described above can be applied to any golf clubs.

The above description is merely for illustrative examples, and various modifications can be made without departing from the principles of the present invention.

What is claimed is:

1. A golf club comprising a shaft having a tip end and a butt end, a head, and a grip, wherein the shaft has a plurality of carbon fiber reinforced layers, the carbon fiber reinforced layers include a straight layer, a bias layer, and a hoop layer, when the hoop layer has a weight that is defined as WF, and the shaft has a shaft weight that is defined as WS, WF/WS is equal to or greater than 0.18, the shaft weight WS is equal to or less than 42 g.

2. The golf club according to claim 1, wherein in the shaft, a point 200 mm distant from the butt end is defined as P1, and a region from the point P1 to the butt end is defined as a specific butt region, a weight of the hoop layer in the specific butt region is defined as WFb, a shaft weight in the specific butt region is defined as WSb, and WFb/WSb is equal to or greater than 0.30.

3. The golf club according to claim 2, wherein the specific butt region includes the hoop layer which comprises three or more plies.

4. The golf club according to claim 1, wherein an inner diameter of the shaft at the point P1 is equal to or greater than 14.0 mm.

5. The golf club according to claim 1, wherein when a weight of the straight layer is defined as WT, WF/WT is equal to or greater than 0.25.

6. The golf club according to claim 1, wherein in the shaft, an EI value at a point 830 mm distant from the tip end is defined as E8, an EI value at a point 930 mm distant from the tip end is defined as E9, and an EI value at a point 1030 mm distant from the tip end is defined as E10, and in a graph obtained by plotting the three EI values E8, E9 and E10 on an x-y coordinate plane in which an x axis represents a distance (mm) from the tip end to a measurement point and a y axis represents the EI value ($kgfm^2$), a gradient of a linear expression obtained by approximating the three plotted points with a least-square method is defined as M3, and the gradient M3 is equal to or less than 0.0100.

7. The golf club according to claim 1, wherein in the shaft, an EI value at a point 1030 mm distant from the tip end is defined as E10, E10 is equal to or less than 5.0 ($kgfm^2$).

8. The golf club according to claim 1, wherein when a distance between the tip end of the shaft and a center of gravity of the shaft is defined as Lg, and a length of the shaft is defined as Ls, Lg/Ls is equal to or greater than 0.50.

* * * * *